United States Patent [19]

Pfarrwaller

[11] 3,998,249

[45] Dec. 21, 1976

[54] CUT-OFF DEVICE FOR A TEXTILE MACHINE

[75] Inventor: Erwin Pfarrwaller, Winterthur, Switzerland

[73] Assignee: Sulzer Brothers Limited, Winterthur, Switzerland

[22] Filed: Sept. 11, 1975

[21] Appl. No.: 612,450

[30] Foreign Application Priority Data

Sept. 20, 1974 Switzerland ..... 12788/74

[52] U.S. Cl. ..... 139/291 C; 139/302; 28/1 CS; 66/140 R

[51] Int. Cl.[2] ..... D03J 1/08

[58] Field of Search ..... 139/122 R, 263, 266, 139/291, 302, 303; 26/7, 10.4, 15; 28/1 CS; 66/140, 145

[56] References Cited

UNITED STATES PATENTS

| | | | |
|---|---|---|---|
| 1,258,656 | 3/1918 | Cunniff | 139/302 |
| 1,835,556 | 12/1931 | Brown | 139/291 |
| 3,225,794 | 12/1965 | Juillard | 139/303 |
| 3,698,447 | 10/1972 | Guerin | 139/303 |
| 3,899,008 | 8/1975 | Budzyna | 139/302 |

*Primary Examiner*—Henry S. Jaudon
*Attorney, Agent, or Firm*—Kenyon & Kenyon Reilly Carr & Chapin

[57] ABSTRACT

The cut-off device is used to cut the selvage of a woven fabric and includes a movable member which is driven by means of a pivotally mounted lever and a flat disc. The disc is carried on a pivotal drive element which is reciprocated off a drive shaft of the machine. The drive shaft disc and lever are located below the fabric plane so as to be moved out of the way should the need arise to repair a broken weft thread.

15 Claims, 9 Drawing Figures

6
7
8
9
11
12
13
14
37
38
40
45
21
22
23
24
25
26
31
32
33
34
36
39
15
16
17
18
50
53

6
7
8
9
11
12
13
14
15
16
17
18
21
22
23
24
25
26
31
32
33
34
36
37
38
39
40
45
53

CUT-OFF DEVICE FOR A TEXTILE MACHINE

This invention relates to a cut-off device for a textile machine and particularly to a selvage cut-off device for a weaving machine.

Heretofore, it has been known to provide weaving machines with cutting devices for cutting off fabric selvages. In one such cutting device, use is made of a movable cutting element in the form of a cutter blade which moves up and down and which is driven by a rod of a selvage forming motion. This type of cutting device is described in Swiss Patents Nos. 394,981 and 447,064. In another case, as described in Swiss Patent No. 421,853 the movable cutting element is in the form of an electrically heated melting wire which is also actuated by a rod of the selvage forming motion. Cut-off devices are also known in which the movable cutting element is formed by shears or a cutter blade with the drive obtained, for example, from a weaving machine heald by means of a linkage.

In these known cut-off devices, the drive elements are disposed substantially above the fabric web and are obstructive, for example, when a weft yarn is pulled in after a weft yarn breakage.

Accordingly, it is an object of the invention to provide a weaving machine with a cut-off device which has a drive which does not obstruct access to the weft yarns of a woven fabric.

It is another object of the invention to drive a selvage cut-off device from a machine shaft located beneath a fabric being woven on a weaving machine.

It is another object of the invention to provide for minimum wear in a cut-off device for a textile machine.

It is another object of the invention to provide a selvage cut-off drive capable of operating over prolonged periods of time with high reliability.

Briefly, the invention provides a cut-off device for a textile machine. Although the cut-off device is useful for many purposes and in various kinds of textile machines including for example, knitting machines, it is particularly suited for a weaving machine and for the cutting off of cloth selvages in looms.

The cut-off device comprises a cutter including at least one movable member and a drive for moving the member which includes a lever, a cooperating flat element and a drive element for producing a reciprocating movement. One of the lever and flat element is connected to the movable member while the other is connected to the drive element for reciprocation. In this device, the drive can be derived without difficulty from a machine shaft situated beneath a fabric being woven.

Preferably, the part of the lever element which engages the flat element is arranged to roll on the flat element. Although the rolling part may be a ball, the rolling part is preferably a roller. The flat element may be a freely rotatable disc in which case it is desirable for at least part of the line of engagement of the lever with the flat element to be non-intersecting with the axis of rotation of the disc. This will tend to produce rotation of the disc thus distributing the wear. The arrangement may be such that the lever and the flat element are held in constant contact with one another during operation or they may separate during part of each cycle.

As mentioned above, the machine may be a loom; in this case, the cut-off device may be used to cut during each cycle of operation of the cut-off device at least one weft thread adjacent one edge of the cloth being woven on the loom. Thus, the cut-off device may be arranged to cut one or other end of a newly inserted weft thread or a fringe of weft threads. Preferably, however, the cut-off device is used to cut off the selvage adjacent the edge of the cloth. In any case, the lever, the flat element and the drive element which causes reciprocation are preferably located below the plane of the cloth in the region of the cut-off device.

These and other objects and advantages of the invention will become more apparent from the following detailed description and appended claims taken in conjunction with the accompanying drawings in which:

Figure 1:
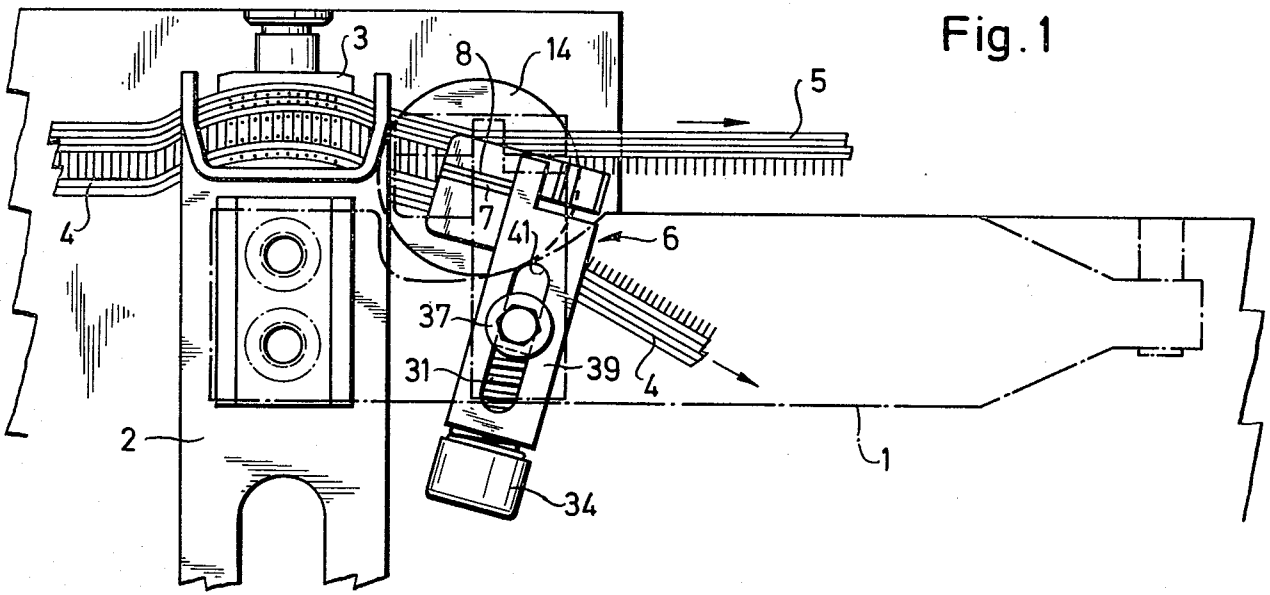
FIG. 1 illustrates a plan view of part of a weaving machine, which uses a cut-off device according to the invention to cut-off the selvage of a fabric being woven.

Referring to FIG. 1, a textile machine such as a weaving machine of any suitable construction for weaving fabric includes a machine frame on which a selvage cut-off device is mounted. To this end, the machine frame includes a fixedly mounted support 1 to which a cover 2 of a temple 3 is secured. The fabric 4 moves in known manner between the cover 2 and temple 3 and the selvage 5 of the fabric 4 is cut off by the cut-off device 6.

Figures 2, 3:
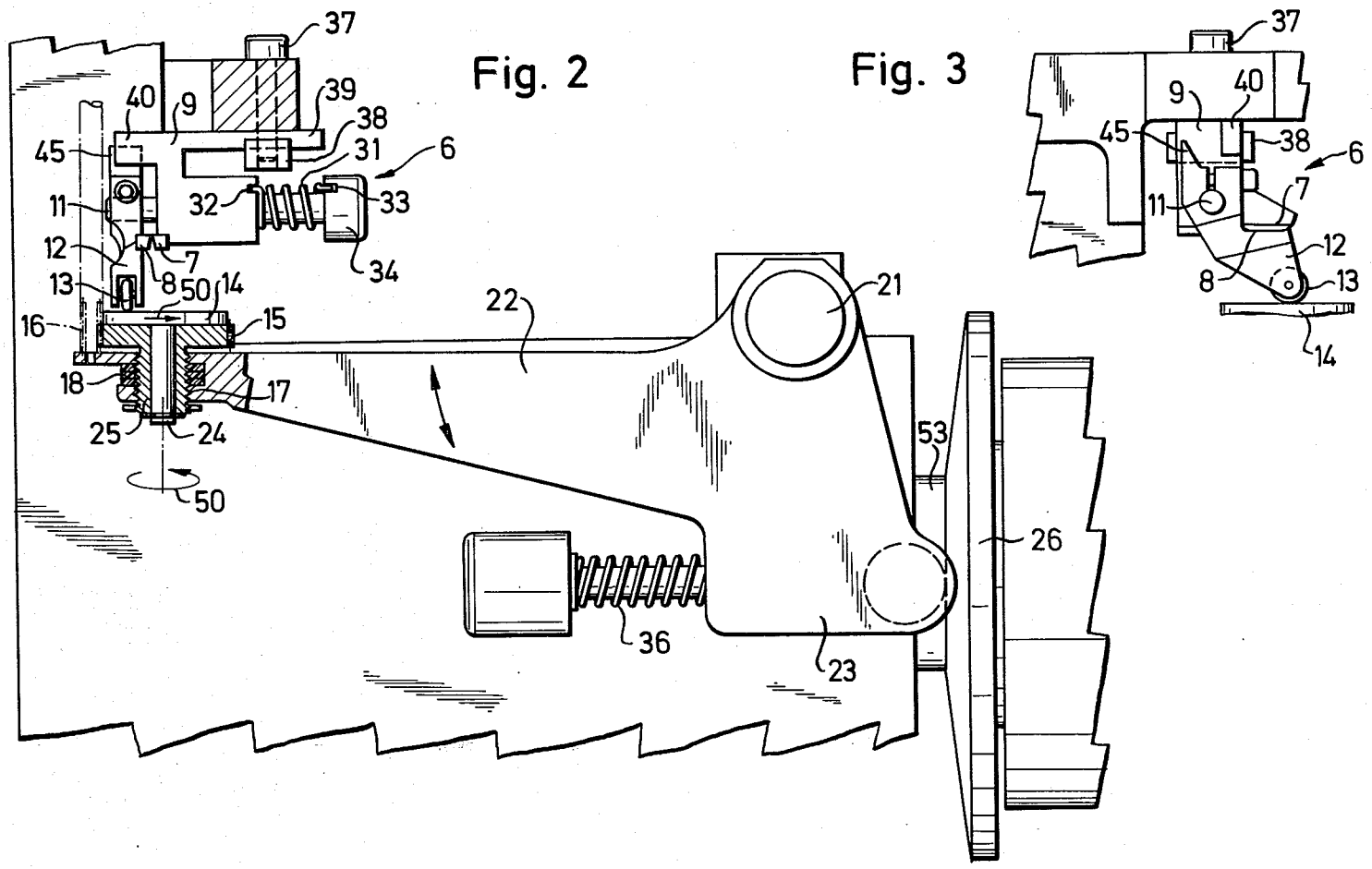
FIG. 2 illustrates a vertical sectional view of the cut-off device with the fabric omitted, in a closed position.
FIG. 3 illustrates an associated elevation of the cut-off device of FIG. 2.

Referring to FIG. 2, the cut-off device includes a cutter in the form of shears with two cutter halves or elements 7, 8. One cutter half or element 7 is fixed on a shaped frame 9 while the other cutter element of half 8 is movably mounted by being fixed on a roller lever 12 which is secured to a shaft 11 pivotally mounted in the frame 9. As shown in FIGS. 2 and 3, the lever 12 has a roller 13 at the bottom end which is mounted to be loosely rotatable and which is, for example, of spherical construction at the periphery. This roller 13 is part of a drive for moving the cutter element 8 and cooperates with a flat element 14 of the drive. The flat element 14 is constructed as a table (e.g. of mushroom shape) in the form of a circular disc having a flat surface facing the roller lever 12 with a pivot shaft or stem 24 which fits in freely rotatable fashion in a mushroom-shaped carrier or bearer element 25 which, in turn, is mounted on a drive element 22. The bearer element 25 has teeth 15 in which a pinion 16 can engage for vertical adjustment purposes as well as a screw thread 17 which matingly engages in a plastics friction nut 18, e.g. a NYLOC stop nut, located in a recess of the drive element 22. On turning by means of the pinion 16, the disc 14 is moved up and down via the screwthread 17 and fixed against unintentional movement by means of the plastics friction nut 18.

The drive element is in the form of a double-arm lever which is mounted to pivot about a pin 21 secured in the machine frame and which has two arms 22, 23. The lever 22, 23 and hence the disc 14 are driven by a cam disc 26 so that the disc 14 is usually guided upwards against the roller 13 once per weaving machine pick and the movable cutter half 8 is moved out of the open position shown in FIGS. 4 and 5 into the closed position shown in FIGS. 2 and 3. A spring 36 is located between a stationary head on the machine frame and the lever arm 23 to bias the lever 22, 23 against the cam 26 and in a counter-clockwise direction as viewed.

A force storage or energy means 31 constructed in the form of a compression-torsion spring has one end engaged in a groove 32 of the frame 9 while the other spring end is secured in a notch 33 in a head 34 on the shaft 11. The cutter elements 7, 8 are thus guided into the closed position against the action of the spring 31 and returned to the open position under the action of the spring 31 when the disc 14 is guided downwards under the action of the springs 36 and 31. The spring 31 also ensures that the two set cutter halves 7, 8 come into contact with one another by pressing the half 8 to the right in FIGS. 2 and 4. In addition, the spring 31 serves to hold the lever 12 and disc 14 in constant contact along with the other spring 36.

A stop 40 is provided on the frame 9 in opposed relation to a nose 45 of the roller lever 12. The nose 45, however, does not meet the stop 40 and there is clearance between them.

In operation, the roller 13 performs a substantially rectilinear reciprocating movement in relation to the disc 14 while the disc 14 can only perform a rotary movement. Further, during operation, the force required for a cut is applied on the closing movement. The friction of the roller 13 and disc 14 is therefore greater than during the opening movement. For this reason, the disc A is always turned somewhat in the direction of the arrow 50, i.e. clockwise as viewed in FIG. 6, as confirmed by experiment, so as to have minimum wear.

Figure 6:
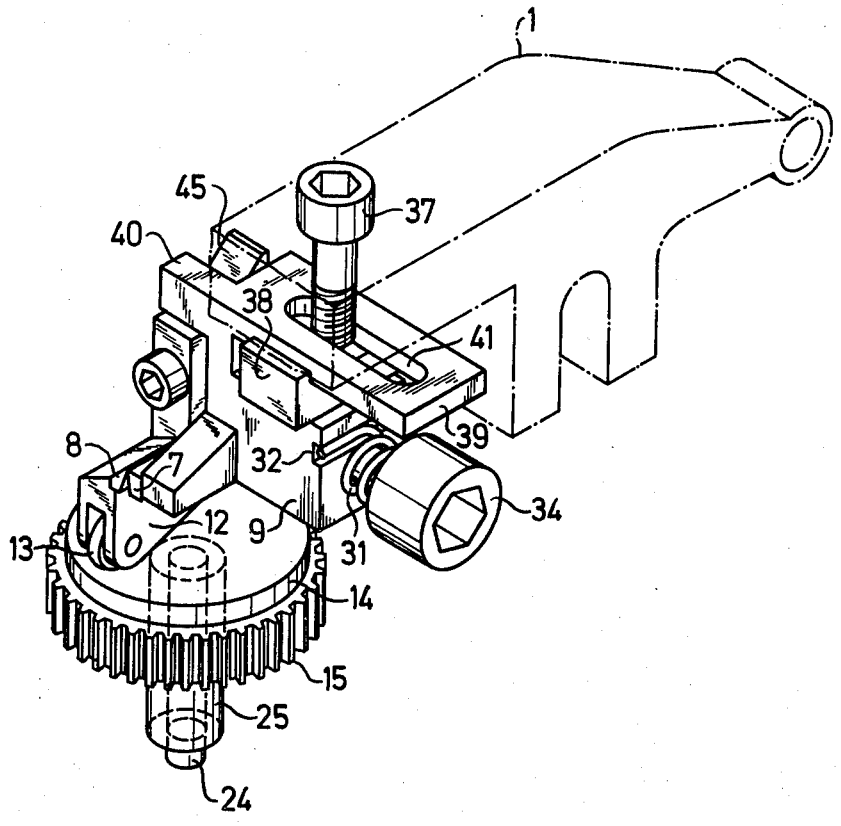
FIG. 6 illustrates a simplified perspective to an enlarged scale showing the device according to FIGS. 2 to 5.

Referring to FIG. 6, the cut-off device 6 is disposed to be rotatable and slidable on the support 1 by means of a screw 37 and a nut 38. To this end, the screw 37 passes through a slot 41 in a part 39 of the frame 9 as well as through the support 1 so as to engage the nut 38 on the underside of the support 1. In this way, by clamping of the part 39, the inclined position shown in FIG. 1 can be obtained. The position of the cut-off device 6 can thus be adapted to the contraction of the fabric 4 after the temple 2, 3. The level of the cut-off device 6 can also be adjusted to the level of the fabric 4 leaving the temple 2, 3 by rotation of the pinion 16. This level may vary according to the thickness of type of fabric.

In another type of operation achievable by means of a differently contoured cam disc 26, the disc 14 continues to move down on the opening movement so that the nose 45 meets the stop 40. There is then a clearance between the disc 14 and the roller 13 in the open position while there is no clearance between the parts 40, 45. The disc 14 then continues to rotate somewhat on each cutting operation.

Figure 7:
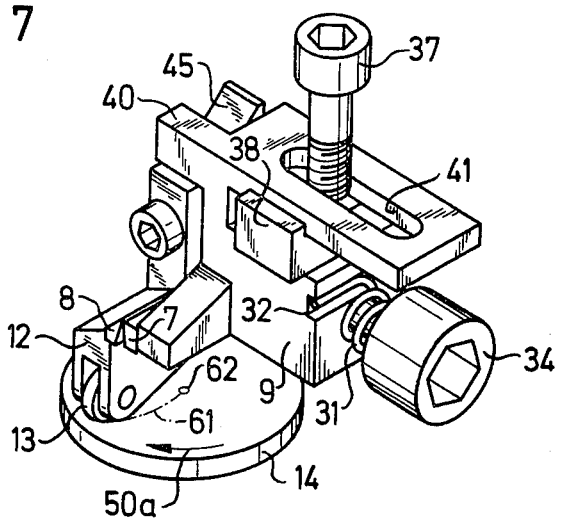
FIG. 7 illustrates the most important parts of the cut-off device of the invention in a modified embodiment.
Figure 8:
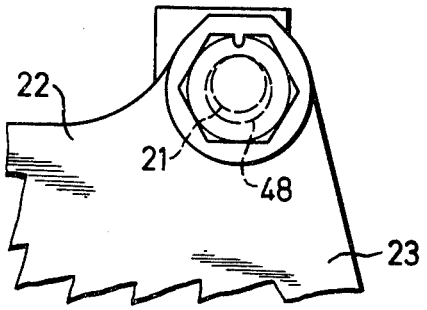
FIG. 8 illustrates an associated detail of the drive of the cut-off device of the invention.

In the modified embodiment shown in FIGS. 7 and 8, there is no part corresponding to the toothed part 15 (FIG. 6) and instead the disc 14 is simply freely rotatable. Vertical adjustment is obtained by means of an adjusting eccentric 48 at the pin 21 (FIG. 8), which provides a higher or lower bearing position for the lever 22, 23.

With this construction, on the closing movement of the cutter the roller 13 moves out of the middle zone 62 of the disc 14 (FIG. 7) outwardly along a curve 61 which departs slightly from a radius only at the outer part. The movement of the parts 8, 12, 13 in the top-left direction of FIG. 7 against the action of the spring 31, as a result of the set of the shears halves 7, 8, then has the effect that the disc 14 is rotated in the opposite direction to FIG. 2, i.e. in the direction of arrow 50*a*.

Figure 9:
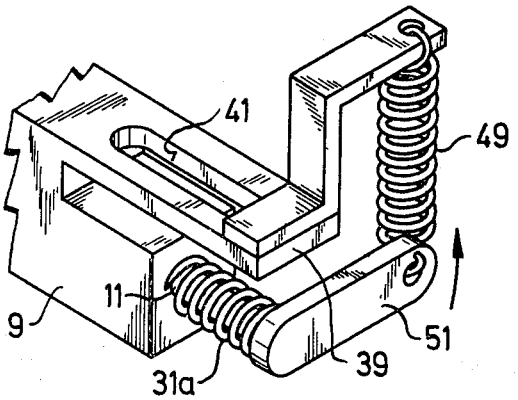
FIG. 9 illustrates a further modified embodiment of a cut-off device according to the invention.

In the example shown in FIG. 9, the spring 31*a* only has the function of pressing the cutter half 8 against the cutter half 7 with another spring 49 attached to an arm 51 secured on the shaft 11 and to a bracket on the part 39 provides the torsional bias. The cut-off device is returned to the open position shown in FIG. 5 by means of the spring 49 after the cut has been made.

Figures 4, 5:
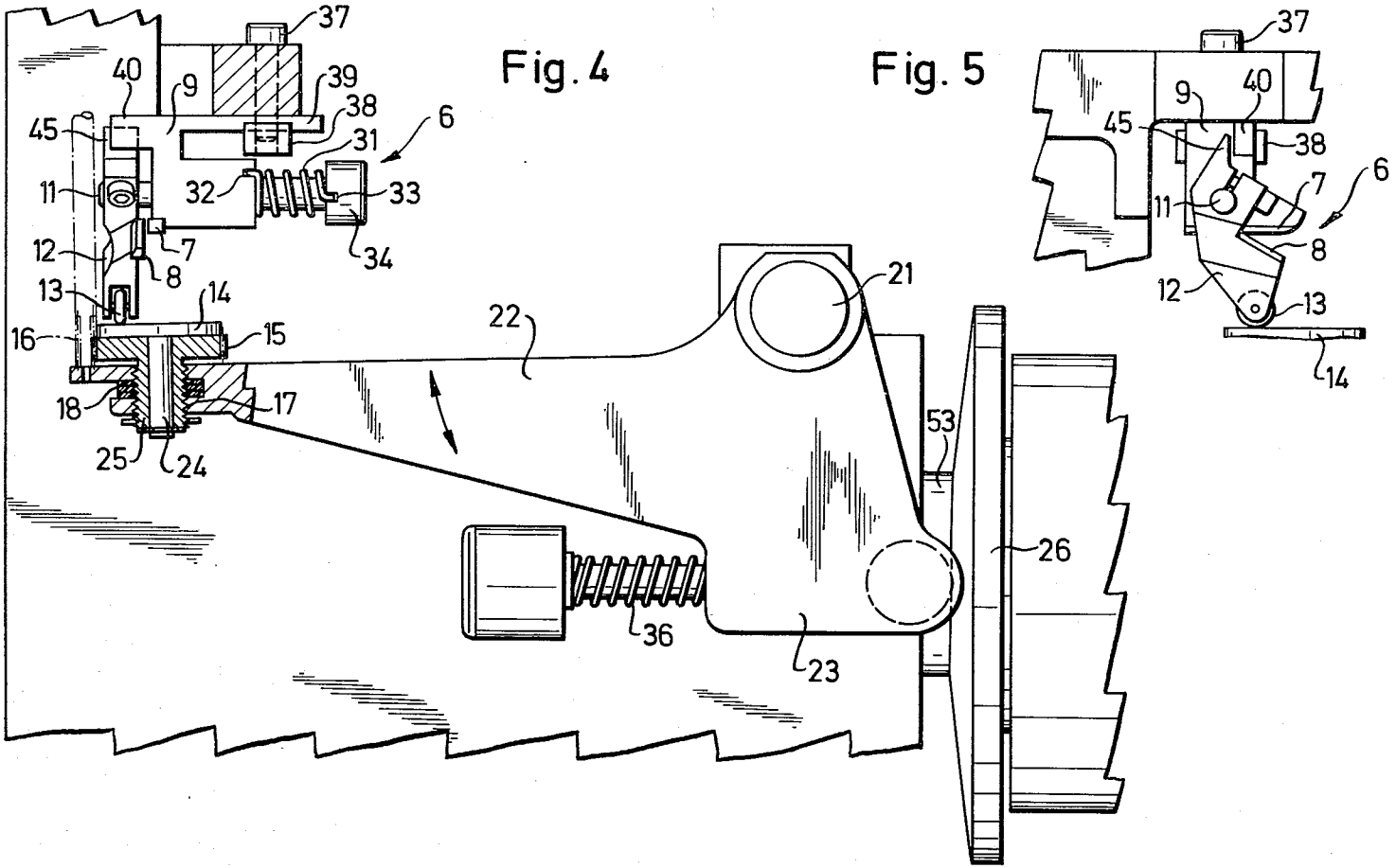
FIG. 4 illustrates a view of the device according to FIG. 2 in the open position.
FIG. 5 illustrates a view of a similar elevation to FIG. 3 of the cut-off device in the open position.

The fabric 4 moving at the level of the cutter half 7, 8 according to FIGS. 2 and 4 is disposed above the drive elements 13, 14, 22, 23 and the drive is taken off a shaft 53 of the weaving machine.

The disc 14 may, if required, have a different shape other than circular. ALso, the arm 22 may carry a roller and the lever 12 may have a bottom flat end against which the roller runs to oscillate the lever 12.

If required, the cut-off device can also be used for cutting off single weft yarns or a fringe of weft yarn ends.

Instead of the friction nut 18, a different means of securing the carrier 25 against rotation may be provided.

In other embodiments, the cut-off device may, for example, be a reciprocating cutter or a red-hot wire or the like, instead of shears, for cutting off pieces of fabric, for example fabric webs, or single yarns. In every case, the drive comprises a roller lever and an associated flat element corresponding to the parts 12, 13, 14.

What is claimed is:

1. A cut-off device for a textile machine comprising a cutter including at least one movable member; and a drive for moving said movable member, said drive including a lever, a freely rotatable disc having a flat surface facing said lever and a drive element for producing a reciprocating movement, one of said lever and said disc being connected to said movable member and the other of said lever and said disc being connected to said drive element for reciprocation thereby.

2. A cut-off device as set forth in claim 1 which further comprises a force storage means for holding said lever and said disc in constant contact.

3. A cut-off device as set forth in claim 2 which further comprises a sleeve-shaped carrier element rotatably supporting said disc thereon, said carrier element including a plurality of peripherally located teeth and an external screw thread; a pinion in meshing engagement with said teeth for rotation of said carrier element, and a support having said screw thread matingly received therein for raising and lowering said carrier element relative to said support.

4. A cut-off device as set forth in claim 3 which further comprises a friction nut for securing said carrier element against rotation.

5. A cut-off device as set forth in claim 1 wherein said disc is adjustably mounted in the direction of said lever.

6. A cut-off device as set forth in claim 5 which further comprises a carrier mounting said disc thereon, said carrier having a screwthread disposed in said drive element on an axis normal to the surface of said disc, and means to produce relative rotation between said carrier and said drive element.

7. A cut-off device as set forth in claim 6 which further comprises friction means between said carrier and said drive element to resist unintentional rotation therebetween.

8. A cut-off device as set forth in claim 1 wherein said lever contacts said disc on a line of engagement which is non-intersecting with the axis of rotation of said disc.

9. A cut-off device as set forth in claim 1 which further comprises means of said lever for contacting and rolling on said disc.

10. A cut-off device as set forth in claim 9 wherein said latter means is a roller.

11. In combination with a weaving machine, a selvage cut-off device comprising a cutter mounted on said machine, said cutting including a movable cutting member; and a drive for moving said cutting member, said drive including a lever, a freely rotatable disc having a flat surface facing said lever and a drive element for reciprocating one of said lever and said disc towards and away from the other; said other of said lever and said disc being connected to said cutting element for movement in response to reciprocation of said one of said lever and disc.

12. In combination with a weaving machine for weaving a fabric in a predetermined plane and having a drive shaft below said fabric plane, a selvage cut-off device comprising a cutter mounted on said machine, said cutter including a fixedly mounted cutter element, a pivotally mounted cutter element, and spring means for pivoting said pivotally mounted cutter element away from said fixedly mounted element; and a drive for pivoting said pivotally mounted cutter element towards said fixedly mounted cutter element, said drive including a lever pivotally mounted on said cutter and carrying said pivotally mounted cutter element thereon, a roller mounted on said lever, a freely rotatably mounted disc in contact with said roller, a pivotally mounted drive element supporting said disc thereon for movement towards and away from said lever, and a cam between said drive shaft and said drive element for pivoting said drive element during rotation of said drive shaft.

13. In combination, a cutter including a frame, a cutting element fixedly mounted on said frame, a shaft rotatably mounted in said frame, and a movably mounted cutting element; and a drive for moving said movably mounted cutting element relative to said fixedly mounted cutting element, said drive including a lever mounted on said shaft and carrying said movably mounted cutting element thereon for pivoting with said shaft, a roller mounted on said lever, a rotatable disc in contact with said roller and a pivotally mounted drive element supporting said disc thereon for movement relative to said lever whereby movement of said drive element causes movement of said movably mounted cutting element relative to said fixedly mounted cutting element.

14. The combination as set forth in claim 13 which further includes a force storage means for holding said lever and said disc in constant contact.

15. A cut-off device for a textile machine comprising a cutter including at least one movable member; and a drive for moving said movable member, said drive including a lever, a cooperating flat element adjustably mounted in the direction of said lever, a drive element for producing a reciprocating movement, one of said lever and said flat element being connected to said movable member and the other of said lever and said flat element being connected to said drive element for reciprocation thereby, a carrier mounting said flat element thereon, said carrier having a screwthread disposed in said drive element on an axis normal to the surface of said flat element, and means to produce relative rotation between said carrier and said drive element.

* * * * *